United States Patent [19]

Linn

[11] 4,258,559

[45] Mar. 31, 1981

[54] BOAT MOTOR LOCKING DEVICE

[76] Inventor: George T. Linn, 871 Wyckford Dr., Apt. E, Indianapolis, Ind. 46224

[21] Appl. No.: 705,071

[22] Filed: Jul. 14, 1976

[51] Int. Cl.[3] ..... E05B 73/00

[52] U.S. Cl. ..... 70/19; 70/58; 70/183; 70/229

[58] Field of Search ..... 70/229, 230, 182, 183, 70/184, 19, 14, 58, 232

[56] References Cited

U.S. PATENT DOCUMENTS

| | | | |
|---|---|---|---|
| 1,625,658 | 4/1927 | Henke | 70/232 X |
| 1,707,266 | 4/1929 | Hillborn | 70/230 |
| 1,801,977 | 4/1931 | Peterson | 70/229 X |
| 2,144,837 | 1/1939 | Douglas | 70/230 |

*Primary Examiner*—Rodney H. Bonck
*Attorney, Agent, or Firm*—Robert A. Spray

[57] ABSTRACT

A boat motor lock means, attachable without tools to many existing boat motors as well as new equipment, which achieves a locking of the boat motor to the boat by locking the motor-clamp bolt against rotation once the clamp bolt has been turned to its desired motor-clamping position.

6 Claims, 5 Drawing Figures

BOAT MOTOR LOCKING DEVICE

This invention relates to a locking device for boat motors, by which a boat motor may be securely locked to the boat; and concepts of the invention provide that the locking device may be very readily and conveniently attached to many existing or new combinations of boats and motors, without tools.

The concepts further provide that the lock readily is movable with the boat motor itself, for example in switching the motor to a different boat, in contrast to lock types which attach to the handle of a motor-clamp bolt.

The concepts further provide a locking device which is so easy to install by most boat-users, as to be almost self-obvious at least with a sketch and/or only a few words of installation text.

More particularly, the concepts provide a locking device which acts between the boat motor and the motor-clamp bolt, to prevent clamp-releasing rotation of the motor-clamp bolt once the locking device is installed and locked, by a lock means whose locking nature and locking abutment with the boat motor are effectively concealed by the motor component to which the locking abutment is made, thus lessening a theft likelihood.

(The term "motor" as used herein refers to the boat-motor generally including its boat-transom clamp-bracket, that bracket usually being a motor-mounting component separate from the boat motor; yet it is herein considered a part of the motor in contrast to the boat or to the clamp-bolt whose function is to clamp the motor and that mounting bracket to the boat.)

The description so far given is rather generalized to serve as an introduction to specifying the inventive concepts more particularly. Specific concepts, features, and details of the invention will be further apparent in the detailed description of an illustrative embodiment thereof, taken in conjunction with the accompanying somewhat diagrammatic and schematic drawings, in which.

Figure 1:
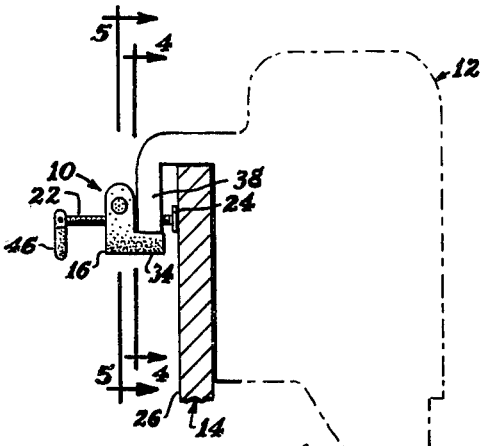
FIG. 1 is a vertical elevational view illustrating a locking device installed onto a boat motor mounted on a boat transom.

As shown in the drawings, the present invention provides a boat motor lock means 10 for locking the boat motor 12 to an associated boat 14.

The lock means 10 is shown as having a body number 16; and there is provided a lock 18 carried by the body member 16, the lock 18 having a locking member 20 movably related to it and manipulatable as by a key 21 by which the locking member 20 is lockingly engageable, at will, with the clamp bolt 22 of the associated boat motor 12. (In the usual installation, the clamp bolt 22 clamps the motor 12 to the boat 14 by pressure of the bolt's end-pad 24 against the boat transom 26.)

Figure 5:
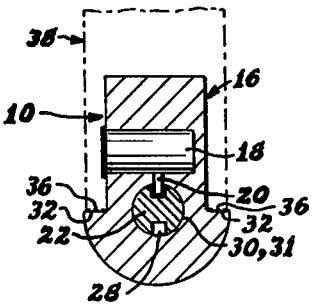
FIG. 5 is a vertical transverse cross-sectional view generally as indicated by View-line 5—5 of FIG. 1, generally similar to FIG. 4, but to illustrate the locking engagement with the clamp-bolt.

In the device of the invention, the engageability of the lock's locking member 20 to the clamp bolt 22 is into whichever of a pair of keyways or slots 28 happens to register with the locking member 20 when in its locking position (FIG. 5); and this locking engagement of locking member 20 into bolt keyway 28 is operative to restrict a motor-releasing rotation of the clamp bolt 22 with respect to the locking member 20.

In the illustrated embodiment, it will be noted that the said body member 16 is provided with means engageable with the said clamp bolt 22 to restrict movement of the clamp bolt 22 axially; and this in the embodiment shown is by providing that the hole 30 of the body member 16, which receives the clamp-bolt 22, is provided with female screw-threads 31 which are screw-threadedly engageable with the clamp bolt 22 itself.

Further, it will be noted that the body member is provided with abutment means 32 engageable with the boat motor 12 and prevents movement of the body member 16 axially with respect to the axis of the clamp bolt 22. More particularly, this engagement as shown is by the provision of a semi-cylindrical hollow extension 34 of body member 16, extending axially of the axis of the clamp bolt 22; and the upwardly-facing edges of the said extension 34 provide the abutment 32 engageable with the lower walls 36 of the mounting bracket 38 of the boat motor 12 so as to prevent movement of the body member 16 which would release or permit release of the boat-clamping position of the clamp bolt 22.

Axial-withdrawal of body member 16 is thus shown as blocked in the illustrative embodiment by the interengagement of its threads 31 with the clamp bolt 22, which blocks axial withdrawal except if in accompaniment with rotation, and by the abutting engagement of 32–36 which blocks that rotation.

Thus the abutment 32 provided by the said body member extension 34 engages the boat motor's mounting bracket 38 so as to prevent withdrawal rotation of the body member 16 about the axis of the clamp bolt 22; and thus not only is the clamp bolt 22 locked by locking lug 20, but the clamp bolt 22 is utilized to help in the retaining of the body member 16, by the clamp bolt's presence in body member hole 30 blocking transverse withdrawal, and by the clamp bolt's threads interfitting the body member's hole threads 31 blocking axial withdrawal. And the aforesaid engagement of abutments 32–36 blocks rotational movement of the body member 16.

As is indicated particularly in FIGS. 1, 3–5, a substantial portion of the body member extension abutment member 34 is located below the axis of the clamp bolt 22, and extends below the portions 36 of the boat motor's mounting bracket 38 which are abutted by the extension member 34, also thus providing and achieving an effective concealment of the abutment and of the abutting engagement (32–36) which provides the said motor-locking operativity, thereby not only providing the motor-locking operativity but lessening the likelihood of a thief's breaking of the lock means, by effectively concealing its nature and components by achieving this extra effect of the boat motor's mounting bracket 38.

To minimize confusion of similar terminology of an "abutment," for it may otherwise not be clear as to whether that term indicates the actual surface or contact point of an abutment or the necessary mass or material of the abutment lug or body which carries that abutting surface, it is to be noted that the portions of the body member extension 34 are noted herein as being the abutting surface 32 (specifically 32*x* or 32*y* as shown on FIG. 2, depending upon which screw-thread "hand" is the clamp bolt 22) and the abutment itself (shown merely by numeral 34); and while the abutting surfaces 32 (32*x*, 32*y*) are shown as high as the axis of clamp bolt 22, the substantial portion of the abutment body 34 is located below the axis of the clamp bolt 22 and below the motor bracket's abutting surface 36, as already noted.

It will be noted that the body member extension 34 has its wall substantially spaced from the axis of the clamp bolt 22, providing that between that wall of extension 34 and the axis of the clamp bolt 22 there is considerable space 41 accommodating various sizes of motor-mounting brackets; and it is in that space 41 that is received the portion 40 of the motor's mounting bracket 38 in which is provided the opening 42 through which the clamp bolt 22 extends, that opening 42 having threads 43 which give the clamp bolt 22 its axial force against the transom 26. The opening 30 is co-axial with the opening 42 when the body member 16 is positioned so that its abutment 32 is in engagement with the motor mound bracket 36 as aforesaid.

Installation

To install the locking device 10, the user merely removes the existing clamp-bolt, and replaces it with the keyed clamp-bolt 22 onto which the body member 16 has been screwed.

(It is not critical that the body member 16 be placed so as to be flush against the motor bracket 38, nor that the extension 34 is wholly underlying the entirety of the shoulder or wall 36 of the mounting bracket 38.)

The clamp-bolt 22 is then tightened in the usual manner, by twisting its handle 46 until the bolt pad 24 is firm against the boat transom 26.

Then, with whichever of the bolt's keyway slots 28 is in upwardly-facing registry with the path of locking lug 20, the lock key 21 is twisted, forcing the locking lug 20 into the bolt slot 28.

Unlocking is obviously just the reverse procedure; and, once the device 10 is installed onto a mounting bracket 38, it may be left thereon even if the motor 12 and its bracket 38 be re-positioned on the same boat or moved to a different boat.

Summary

It is thus seen that a boat motor locking device according to concepts of the present invention provides novel and advantageous concepts and features, providing not only a motor lock but one which is readily and conveniently installable, without tools, and which scarcely any mechanical or assembly aptitude of the user being required. It fits a variety of types and sizes of mounting brackets, even in the single size and form here shown; and the concepts may be adapted to other type brackets merely by providing any abutment which will abuttingly engage any part of the boat's mounting bracket to restrict rotation of the body member as here illustrated by engagement of abutting components 32 and 36.

The device is usable for both existing boats and motors, and for new ones as well. It is readily moved with a boat motor which is being transferred to a different boat; and it does not interfere with the manipulation of bolt-handle 46.

Only a single device 10 is considered necessary for any installation even though boat motors generally have a pair of clamp bolts.

Accordingly, it will thus be seen from the foregoing description of the invention according to this illustrative embodiment, considered with the accompanying drawings, that the present invention provides a new and useful boat motor locking device which achieves the desirable goal of an easily installable and easily usable motor lock, having desired advantages and characteristics, and accomplishing its intended objects, including those hereinbefore pointed out and others which are inherent in the invention.

Modifications and variations may be effected without departing from the scope of the novel concepts of the invention; accordingly, the invention is not limited to the specific form or arrangement of parts herein described or shown.

Figure 2:
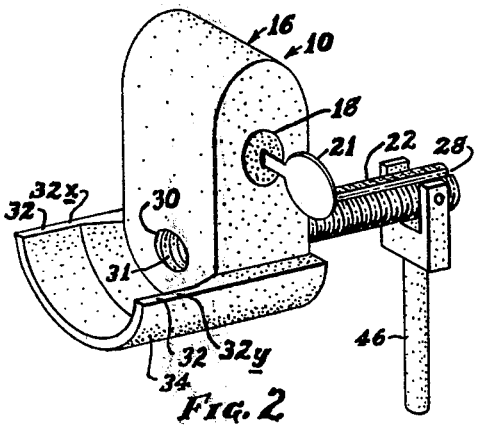
FIG. 2 is a pictorial detail view of the locking device, looking somewhat downwardly at it and from the side thereof, in the orientation thereof as shown in FIG. 3, and to avoid obscuring the transom-engaging bolt-pad and bolt-portion is shown as broken away.
Figure 3:
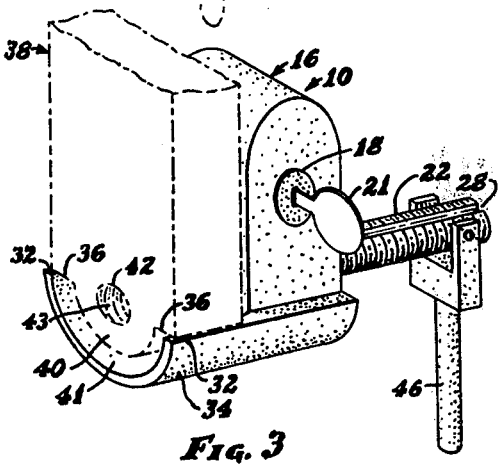
FIG. 3 is a pictorial detail view of the locking device generally as shown in FIG. 2, but showing it as installed onto a boat motor and boat-clamp bolt installation, except that the clamp-bolt is shown provided with a locking key-way or slot, and to avoid obscuring the transom-engaging bolt-pad and bolt-portion is shown as broken away.
Figure 4:
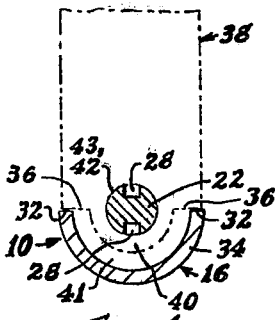
FIG. 4 is a vertical transverse cross-sectional view generally as indicated by View-line 4—4 of FIG. 1.

Thus, for example, although the extension 34 is illustrated as of semi-cylindrical shape, the concepts are not limited to such shape or configuration; for, although that configuration adds strength and may perhaps make for construction desirability or ease of installation understanding, it is apparent that with most champ-bolts 22 being of "right-hand" thread nature, the only wall 32 which actually serves as a bracket-engageable abutment is the one marked 32*x* in FIG. 2. (The wall 32*y* (FIG. 2) on the other hand, serves in the prior operation of installing the locking means 10; that is, the wall 32*y*, by abutting the bracket wall 36 during installation, holds the body member 16 from turning while the clamp bolt 22 is being turned to exert the motor-clamping force against the bolt transom 26, assuring that the other abutment wall 32*x* will be in its proper abutting position against its bracket-wall 36 to provide the locking function preventing removal of the boat motor. This is another advantage of the semi-cylindrical configuration of the extension 34.) Moreover, although two keyways 28 are shown as for locking of the clamp-bolt 22, others may be used, even of other type of bolt-gripping nature although the rigid positiveness of a lug-and-slot bolt-locking nature seems desirable.

What is claimed is:

1. A boat motor lock means, for locking the boat motor to the associated boat, said lock means being of a type comprising:

a body member;

a lock carried by the body member and having a locking member movably related to the body member, the locking member being lockingly engageable with the clamp bolt of the boat motor which clamps the motor to the boat, the locking engageability of the said locking member to the clamp bolt, being operative to restrict a motor-releasing rotation of the clamp bolt with respect to the locking member;

the said body member being provided with means engageable with the said clamp bolt to restrict movement of the clamp bolt axially;

the body member being provided with an opening which receives the clamp bolt and also provided with an extension extending axially to the axis of the clamp bolt, said extension providing an abutment engageable with the mounting bracket of the boat motor so as to prevent movement of the body member which would release or permit release of the boat-clamping position of the clamp bolt;

in such lock means, the improvement comprising the provision of said body member extension as an abutment member, a substantial portion of which is located below the axis of the said clamp bolt and extends below the portion or portions of the boat motor's mounting bracket which is or are abuttingly engaged by the abutting surface of the said extension, thereby providing that the said abutment member and its abutting surface in abutting engagement with the motor mounting bracket provide and achieve not only a motor-locking effect specified above but also that the said motor mounting bracket is utilized to provide and achieve an effective concealment of the abutting engagement of the said abutting surface and the mounting bracket which provides the said motor-locking operativity, thereby not only providing the motor-locking operativity but lessening the likelihood of a thief's breaking the lock means, by effectively concealing its nature and components by achieving this extra effect of the boat motor's mounting bracket.

2. The invention as set forth in claim 1 in a combination in which the clamp bolt is provided with a slot means into which the lock's locking member is caused to be disposed in the locking position.

3. The invention as set forth in claim 1 in a combination in which the body-member's engagement with the clamp bolt includes a female screw-thread means screw-threadedly engageable with the clamp bolt.

4. The invention as set forth in claim 1 in a combination in which the said body member extension is of a generally hollow semi-cylindrical configuration.

5. The invention as set forth in claim 4 in a combination in which the abutment provided by the said body member extension is substantially spaced from the axis of the clamp bolt, providing that between it and the axis of the clamp bolt there may be received a portion of the motor's mounting bracket in which is provided the opening through which the clamp bolt extends.

6. The invention as set forth in claim 1 in a combination in which the abutment provided by the said body member extension is substantially spaced from the axis of the clamp bolt, providing that between it and the axis of the clamp bolt there may be received a portion of the motor's mounting bracket in which is provided the opening through which the clamp bolt extends.

* * * * *